United States Patent [19]

Stump

[11] Patent Number: 4,640,056

[45] Date of Patent: Feb. 3, 1987

[54] VERTICALLY SELF-CENTERING FEED ASSEMBLY

[75] Inventor: Lee E. Stump, Brooklyn Park, Minn.

[73] Assignee: Timesavers, Inc., Minneapolis, Minn.

[21] Appl. No.: 722,117

[22] Filed: Apr. 11, 1985

Related U.S. Application Data

[63] Continuation of Ser. No. 507,353, Jun. 24, 1983, abandoned.

[51] Int. Cl.[4] ..... B24B 21/04

[52] U.S. Cl. ..... 51/138; 51/140; 51/80 A; 51/215 E; 198/836; 144/242 A; 144/245 A; 144/249 R

[58] Field of Search ..... 51/80 A, 87 R, 112, 51/135 R, 137, 138, 139, 140, 215 E; 198/627, 628, 816, 836; 144/242 A, 245 R, 245 A, 249 R, 249 A, 250 R

[56] References Cited

U.S. PATENT DOCUMENTS

| | | | |
|---|---|---|---|
| 2,671,992 | 3/1954 | Reaser et al. | 51/80 A |
| 3,035,685 | 5/1962 | Raynor | 198/816 X |
| 3,166,874 | 1/1965 | Bottcher | 51/87 R |
| 3,178,860 | 4/1965 | Clyne | 51/140 X |
| 3,510,987 | 5/1970 | Ernst | 51/138 |
| 3,516,539 | 6/1970 | Gulstrom et al. | 198/836 X |
| 3,895,464 | 7/1975 | Kiser | 51/140 X |
| 4,322,919 | 4/1982 | Gerber | 51/139 |

*Primary Examiner*—Robert P. Olszewski

*Attorney, Agent, or Firm*—Orrin M. Haugen; Thomas J. Nikolai; Frederick W. Niebuhr

[57] ABSTRACT

A belt driven feed assembly having a plurality of floating passive pinch wheels and a plurality of floating drive wheels, staggered and offset from one another, for conveying flat stock having irregular upper and lower surfaces. The drive and pinch wheels coact with one another and the belt to vertically center the flat stock relative to a stationary milling assembly, whereby irregularities in the upper and lower surfaces are removed so as to obtain finished flat stock with relatively smooth and parallel upper and lower surfaces.

5 Claims, 5 Drawing Figures

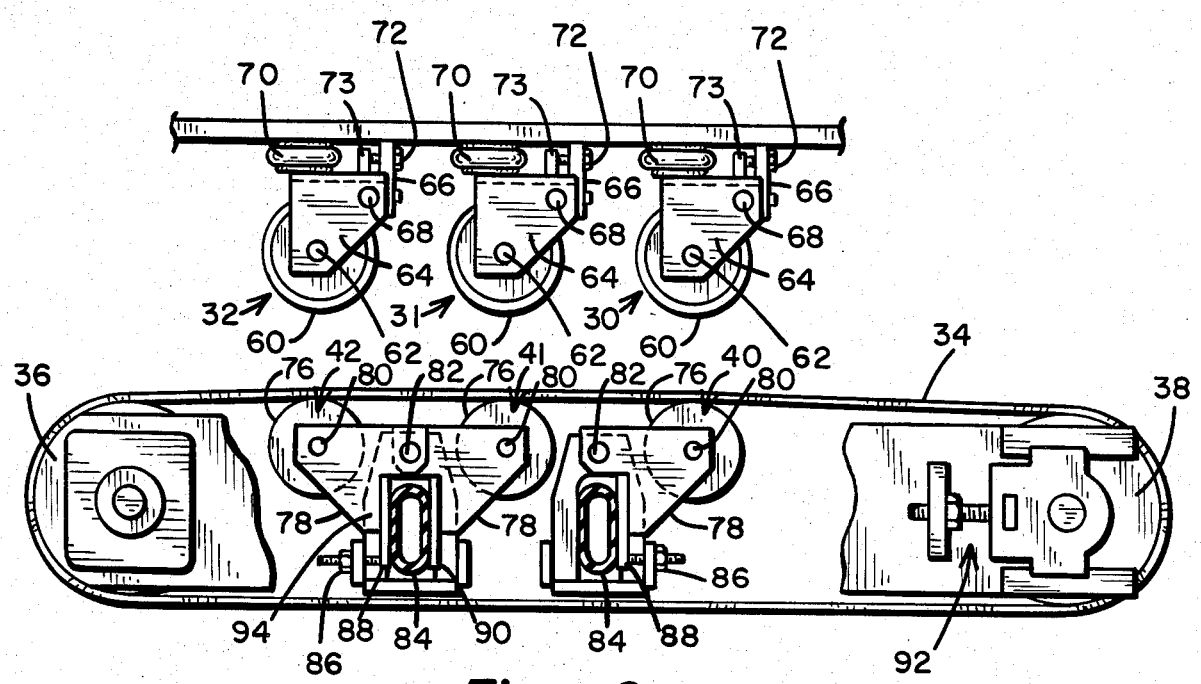
Fig. 2
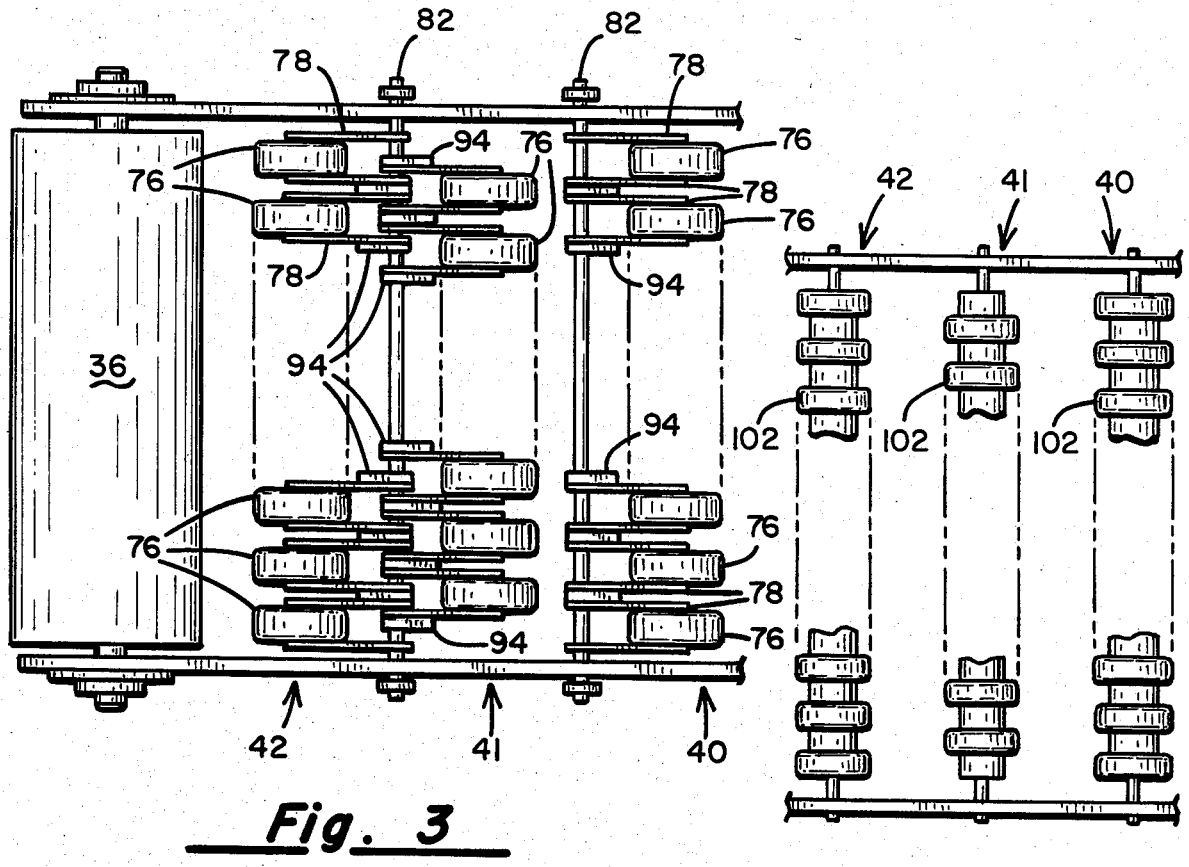
Fig. 3
PRIOR ART
Fig. 5

VERTICALLY SELF-CENTERING FEED ASSEMBLY

This is a continuation of application Ser. No. 507,353, filed June 24, 1983, now abandoned.

BACKGROUND OF THE INVENTION

The present invention relates to conveyor systems and in particular to a vertically self-centering, belt driven conveyor system for surfacing machinery such as rough lumber abrasive planers utilizing endless abrasive belts, and wherein the system is adapted to remove substantially equal quantities of material from both sides of the lumber being treated without damaging, marring, scratching or otherwise generating surface irregularities on the work.

Driven belt conveyor systems have long been used as an infeed for delivering various flat stock to a variety of surface treating machinery including rough lumber being delivered to or passed through an abrasive planer. Such infeed conveyors typically utilize a base belt having one or more pinch wheels mounted thereabove. One or more drive rollers are utilized to drive the conveyor belt and the flat stock such as rough lumber is supported on the belt and held in the zone between the belt and the pinch wheels while moving through the machine. In this fashion, the flat stock is typically indexed relative to the surface of the moving conveyor belt rather than the stock itself and accordingly unequal amounts of materials are normally removed from the two major surfaces of the stock as it moves through the surfacing machinery. Furthermore, such systems assume that each stock element or workpiece being treated has at least one relatively flat surface and that any irregularities in individual incoming workpieces are averaged out over the entire supply. One problem which has frequently developed in conveyor systems which function as a driving means to pass work through any type of surfacing machinery has been the creation of mars, scratches or other imperfections on the surface. The creation of any such surface imperfection is a particularly undesirable result, particularly with wood designed for use as furniture or finishing material. While apparatus for finishing a single surface of material have been widely utilized, such apparatus has a disadvantage of either requiring multiple passes on a single machine, or requiring spaced apart operations on a single such machine. Either type of machine is more costly to operate than the apparatus of the present invention, and any added handling operations tend to increase the likelihood of creation of mars or scratches on the surface of the work being finished.

An example of a piece of single surfacing apparatus for minimizing finish irregularities can be seen upon reference to U.S. Pat. No. 3,694,966. An elastically flexible load beam is disclosed therein which coacts with the endless abrasive belt to vary the pressure applied to the stock being surface finished. In such system, however, the entire work station or surfacing element is moved in response to the sensing of irregularities in the stock. By way of contrast in the present apparatus, the supports for the conveyor flex or shift in response to irregularities in stock thickness so as to maintain the central axis or plane of the stock at a constant vertical elevation, while the supports for the abrasive machinery which determine the working plane of the abrasive belts normally remain stationary.

Two shortcomings of prior systems however are that while such dimensional averaging techniques may apply for most pieces of stock, they do not apply in all cases, and it is the unusual occurrence which tends to create problems in the finished product. For example, due to the randomness of occurrences of irregularities in the incoming stock, waves or cusp patterns may be generated in the finished surfaces. Also, one sided surfacing machines require more finishing time, in that multiple passes are required in order to reduce the stock to its ultimate finished thickness.

The present invention is concerned with surfacing equipment that simultaneously finishes the upper and lower surfaces of rough stock, without requiring periodic movement or adjustment of the surfacing assemblies, with the equipment being adapted to remove substantially equal amounts of excess material from both surfaces of the stock. Consequently, the apparatus of the present invention employs two stationary endless abrasive belt sanders and a novel feedworks that vertically and laterally centers the incoming unfinished stock relative to the working surfaces of the endless abrasive belts. Details as to the construction of typical endless abrasive belt sanding apparatus which are adapted for use with the present invention can be found upon reference to U.S. Pat. No. 4,594,815, or U.S. Pat. No. 4,187,645 (both of which are assigned to the present assignee).

In accordance with the present invention, proper stock alignment for incoming workpieces is achieved via a vertically floating feedworks assembly, whereby irregularities in the thickness of the incoming workpieces are accommodated by the simultaneous flexural response of both upper and lower pinch and drive rollers. Therefore, irregularities in thickness of incoming stock are sensed and accommodated without vertically varying the elevation of the central plane of the individual workpieces as they are fed in and through the surfacing apparatus. The inventon employs a lower workpiece supporting conveyor belt which is held in contact with the incoming workpieces by a plurality of individual pivotally mounted floating support wheels associated with the drive assembly. These individual floating support wheels are spaced apart from one another both longitudinally and transversely, and otherwise arranged in a staggered relationship and are pivotally mounted on the base frame so as to permit deflection or flexure upon detecting or sensing surface irregularities along the underside of the incoming workpiece, with the deflection or flexural response of the floating support wheels permitting uninterrupted feed of the unfinished stock. This uninterrupted incoming feed is accomplished without varying the central plane of the individual incoming workpieces. Lateral or side movement is also minimized due to the forgiving but firm gripping action of the pivotally mounted support wheels, with a relatively constant pressure being thereby maintained across the width of the stock.

The apparatus of the present invention employs a lower work supporting drive means, such as a reinforced rubber conveyor belt along with a cooperating upper hold-down means such as a second plurality of individual pivotally mounted floating support wheels, with the combination neither marking nor marring the lumber stock or work as it is moved through the working stations of the machine. The arrangement is such that the incoming feed exerts a constant force on the incoming work. Such treatment of the work reduces the danger of marring or marking the surface of the lumber, and at the same time advantageously permits clean-up operations to be performed on lumber of scant or slight thickness dimensions. Such advantages are not available from other known types of mechanical feeds, and are particularly unavailable from those which have been found to create surface defects when irregular work is passed therethrough.

It is therefore a primary object of the present invention to provide an incoming feed assembly for drivably supporting workpieces on its upper and lower surfaces in a floating fashion.

It is another object to provide an assembly having upper and lower sets of individually mounted floating support wheels, with the lower set including a plurality of floating support wheels for maintaining a portion of the flight or span of a work supporting conveyor belt at a desired elevation, with the overall assembly being designed to deliver work stock into a surface treating station under a substantially constant force.

It is a further object to provide a mounting arrangement for floating work supporting wheels in a spaced apart and laterally staggered relationship such that each successive wheel encounters various different surface areas of the workpieces moving therethrough.

It is a still further object of the present invention to provide for means to independently and pivotally mount each of the individual floating support wheels in mutually adjacent staggered relationship, one for another, so as to minimize or prevent axial movement or wandering of the incoming workpieces.

The above objects and advantages, as well as others, will however become more apparent upon reference to the following description with respect to the following drawings.

SUMMARY OF THE INVENTION

In accordance with the present invention, a vertically self-centering feed assembly is provided, which comprises a drive belt having a workpiece supporting span which is held in position by a plurality of individually pivotally mounted support wheels, and with the arrangement further including a second plurality of floating support wheels mounted above the surface of the drive belt. These components collectively make up an incoming drive or a driven feedworks assembly. In the present arrangement, the driven feedworks assembly includes at least two rows of floating support wheels mounted beneath the top span of an endless conveyor belt, and with individual members of adjacent rows of wheels being staggered longitudinally as well as transversely along the extent of the assembly. Also, the arrangement of the individual floating support wheels is such that the incoming workpieces move along a substantially straight line, and do not deflect laterally when moving through the feed assembly.

At one operative embodiment, each of the floating support wheels is mounted on an individual pivotally movable bracket, and the individual brackets are in turn pivotally secured or mounted on a transverse shaft. In this embodiment, any size irregularity or warpage in work stock moving therethrough causes the floating support wheel to deflect pivotally upwardly or downwardly in response to the irregularity. The deflection of the floating support wheel and the resistance to pivotal motion is further controlled by means of a counter-force created by an air bladder assembly in contact with the pivoting support brackets, with the air bladder producing a substantially constant force resisting pivotal motion of the support wheels induced by workpieces particularly oversized workpieces. The magnitude of the counter-acting force is preferably operator-adjustable by means of a tensioning system described more fully hereinafter.

IN THE DRAWINGS

FIG. 2 is a detail side elevational view, partially broken away, and illustrating the infeed conveyor employing the features of the present invention;

FIG. 3 is a top plan view of the conveyor portion, with the conveyor belt being removed therefrom, with this view also showing the details of mounting for the upper pinch wheel assemblies;

FIG. 5 is a view similar to FIG. 3, but illustrating a support roller arrangement for a prior art infeed conveyor.

DESCRIPTION OF THE PREFERRED EMBODIMENT

Figure 1:
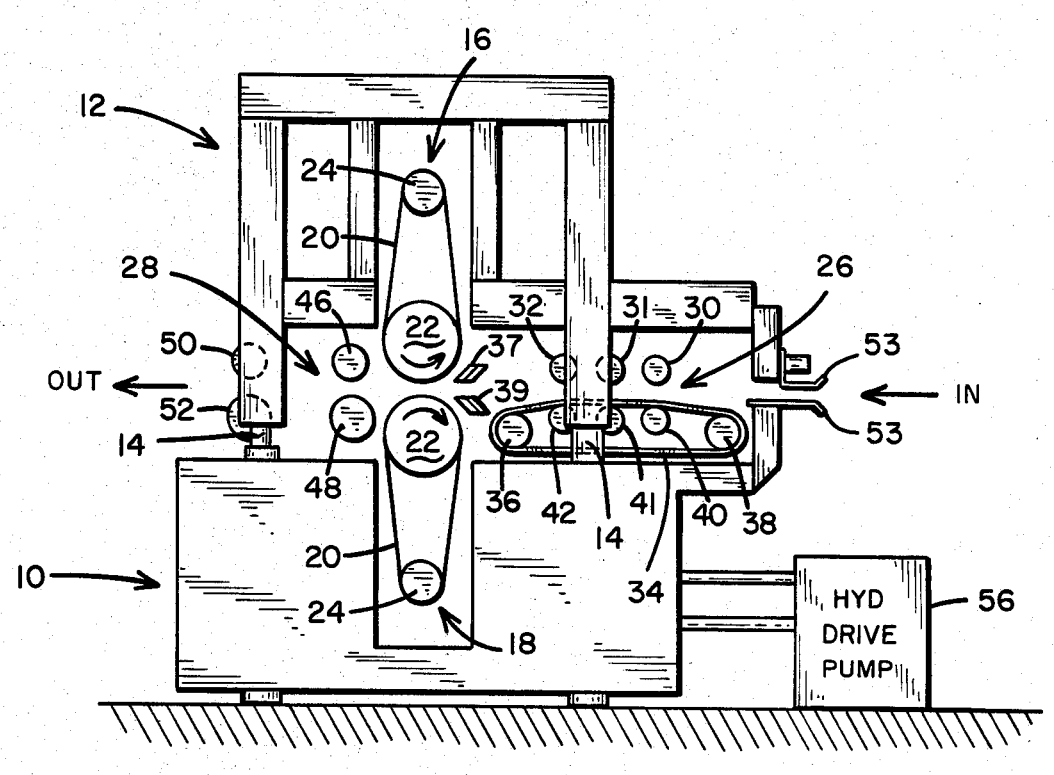
FIG. 1 is a front elevational view of a rough lumber abrasive planer apparatus employing the feedworks of the present invention, and illustrating the infeed portion as well as the output portion of the apparatus.
Figure 4:
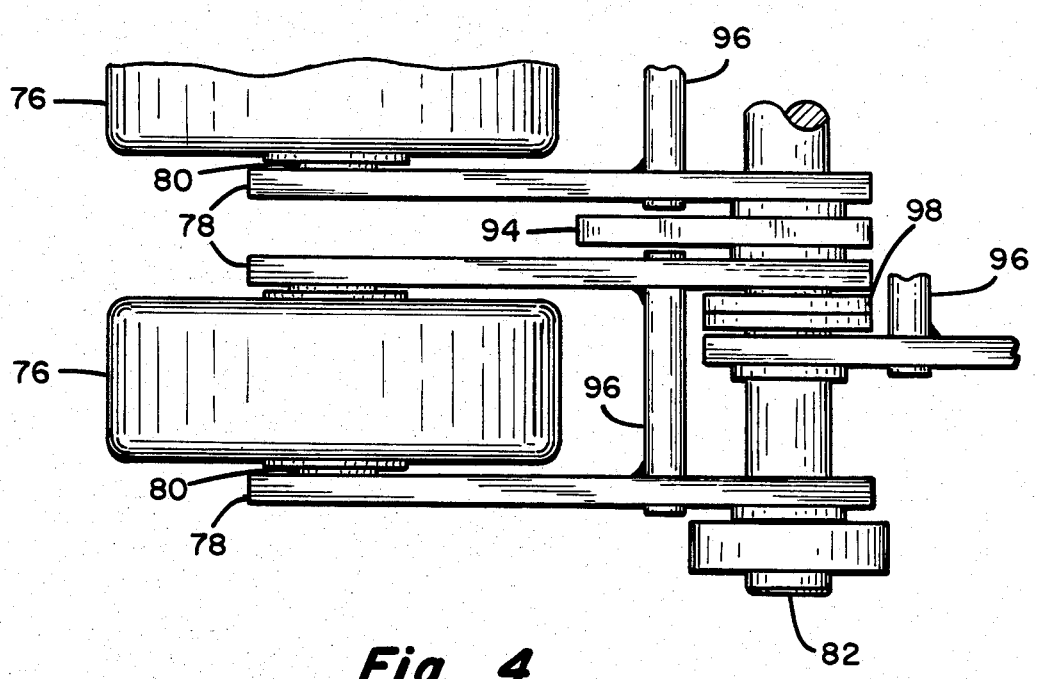
FIG. 4 is a detail top plan view, on a slightly enlarged scale, of the support wheels employed in the conveyor, with FIG. 4 being an enlarged segment of that portion of the apparatus illustrated in FIG. 3.

Attention is directed to FIG. 1 of the drawings, which is a generalized front view of a rough lumber abrasive planer apparatus employing the floating self-centering belt driven conveyor system of the present invention, with FIG. 1 illustrating the primary components of the apparatus and their relationship one to another. Typically, the entire apparatus is enclosed in a steel shroud or enclosure (not shown) and except for side openings, a front-mounted operator control panel, and a feedworks or incoming conveyor viewing window, the apparatus is ordinarily inaccessible to the operator. Accordingly, once the controls are set to achieve a desired finished board thickness, the operator thereafter is only required to feed the rough cut lumber into the infeed side of the apparatus and collect or otherwise gather the surfaced or finished lumber after it has been delivered from the outfeed side. The present apparatus, in particular, accepts rough cut lumber up to 6 inches in thickness and up to about 24 inches in width and is variably adjustable to remove up to one inch of material in a single pass and produce a flat finished surface having a tolerance of plus or minus 0.005 inches. Such capability, of course, may be modified or increased by design parameters.

The apparatus is essentially comprised of a lower work bed 10 utilizing a frame fabricated from rectangular steel framing members and an overlying and adjustably positioned upper work bed 12. The upper work bed 12 utilizes a frame fabricated from heavy gauge rectangular steel framing members and is supported by four mechanical jacks equipped with controlled guides or movable shafts such as screw-jacks 14. Depending upon the thickness of the rough stock and accordingly the amount of material to be removed, the upper work bed 12 may be raised or lowered to accommodate the stock and also achieve the desired finish thickness.

Associated with each of the upper and lower work beds 12 and 10 are upper and lower endless abrasive belt sanding assemblies 16 and 18, respectively. The abrasive sanding assemblies 16 and 18 support respective endless abrasive belts 20 which are typically selected with a desired coarseness of grit, such as, for example, 24/40 or 50 grit finishes. It is to be recognized though that the coarseness of the grit finish may be selected based upon considerations of the stock material being treated and the number of operations required to reduce the rough stock to its desired finish as well as thickness dimension. Each of the sanding assemblies 16 and 18, are, in turn, comprised an 11½ inch diameter driven drum 22 and an 8 inch diameter idler drum 24. It being understood, of course, that other operational parameters may dictate the use of drums of different sizes. In operation and as is typical, the drums 22 and 24 and endless abrasive belts 20 rotate in a direction such that the motion of the endless abrasive belts opposes the direction of stock flow. In addition to those operating parameters which favor this direction of motion, the arrangement also facilitates the evacuation of the dust particles which are formed when solid material is removed from the workpieces, with dust being collected via an appropriate dust collection system.

A feedworks employing an infeed portion 26 and outfeed conveying portion or assembly 28 is, in turn, respectively comprised of a number of driven wheels and associated drive rollers. In particular, the infeed portion of the feedworks assembly 26 is comprised of three upper or overlying full width pinch wheel assemblies 30, 31, and 32, affixed to the frame of the upper work bed 12, and an associated lower or underlying driven endless conveyor belt 34. The belt 34 is typically 25 inches wide and about ⅜ inches thick and is fabricated from a durable reinforced rubber material. Design considerations will, of course, dictate the dimensions of these portions of the overall system, with these dimensions being deemed typical for most conventional operations. The conveyor belt 34 is trained about and moves around driven end roller 36 and tension adjusting idler roller 38, with rollers 36 and 38 being arranged at opposed ends of endless conveyor belt 34. Intermediate the rollers 36 and 38 are a plurality of sets of floating support wheel assemblies 40, 41 and 42. The drive roller 36, in turn, is driven via or coupled to an associated drive motor (not shown) and linkage (not shown) mounted in the back of the cabinet. Such motor drives are, of course, typical and well known in the art. Similarly, the drive motor, linkage and connecting belt (not shown) for each of the abrasive sanding assemblies 16 and 18 are mounted in the back of the enclosure.

Upon leaving the abrading area, the rough cut lumber is conveyed or pushed via the feedworks 26 so as to pass between stationary, full width upper and lower pinch wheels 46 and 48. Typically, these wheels are sized to respective 6 inch and 8 inch diameters. The lower pinch wheel 48 is driven with both rollers being rotatably journaled, to support the finished lumber as it is delivered or conveyed to the outfeed area.

Upon leaving the pinch wheels 46 and 48, the finished lumber is received by pinch wheel 50 and driven roller 52, which are substantially the same as the pinch wheels 46 and 48, and from which the finished stock passes to a delivery station or to the waiting operator. The upper pinch wheels 46 and 50 and the lower pinch wheels 48 and 52 are each respectively contained by the upper and lower work bed frames so as to move with the respective frames so as to accommodate the roll separation desired to receive and handle the workpieces.

Returning to the infeed portion 26, it is to be noted that the linkage to the drive roller 36 is driven via a hydraulic drive pump 56, which may be mounted external to the primary enclosure. Also, it is to be noted that an extension linkage (not shown) couples the drive linkage of the drive roller 36 to the drive roller 52 and 48. Therefore, the present conveyor system is essentially hydraulically driven so as to provide a constant force with a variable feed speed for each workpiece entering the apparatus. Thus, the feed speed varies with the working load encountered by the abrasive belts so as to prevent mechanical overloads from occurring in the sanding heads. Such an arrangement is readily achieved by utilization of a hydraulic pressure-compensating pump in the hydraulic drive pump assembly 56.

Before continuing, it is again to be recognized that should additional information be desired with respect to various portions of the present apparatus, attenton should be directed to copending patent application Ser. No. 258,613, filed Apr. 29, 1981, entitled "Abrasive Surfacer", abandoned in favor of continuation application Ser. No. 509,793, filed July 1, 1983 now abandoned and which has been superceded by a continuation application Ser. No. 679,285 filed Dec. 7, 1984. Somewhat similar apparatus is described therein, but which apparatus does not contain the present improved infeed assembly 26.

Attention is now directed to FIGS. 2 and 3 wherein a partially sectioned, detailed view is shown of the infeed portion of the feedworks assembly 26. With reference to the sets of floating pinch wheel assemblies 30, 31 and 32 shown therein, it is to be noted that each individual wheel assembly is comprised of a number of transversely spaced-apart wheels 60 60 fabricated from a suitable wear resistant material, or having a surface covering fabricated from such a material, with the wheels preferably having a hardness of between 70 and 80 durometer (Shore A). Typically, the individual wheels are approximately 8 inches in diameter and 4 inches long, it being understood that other dimensions may be employed as well. The utilization of a number of individual rollers in a transverse line constitutes a composite assembly of floating pinch wheels. In the upper pinch wheel assemblies, each wheel 60 is supported via a center axle 62 that, in turn, projects through a side member or bracket 64 that is adjacent each side of the wheel 60. In the lower assembly, the individual wheels such as wheels 76—76 are mounted for rotation on a shaft held between mating brackets 78—78, with the brackets 78 being in turn pivotally and rockably mounted on shaft 82. The side members 64 are, in turn, pivotally secured to the upper work bed frame 12 by means of offset axle shaft 68 which extends through the individual side members 64. The stop assemblies 66 act to limit the rotation of individual side members 64 (and their wheels 60) about axle shaft 68. Accordingly, the individual wheels 60 and side members 64 may rotate in an arcuate fashion upwardly or downwardly in response to the irregularities encountered in the rough lumber passing through the feedworks. The actual arcuate deflection of each pinch wheel 60, however, is resisted by compression of associated air bladders 70 until adjustable stop bolt 72 is encountered by pad 73 which is welded or otherwise secured to each pair of side members 64—64, and pivots with its associated pinch wheel 60. Thus, depending upon the amount of motion desired for pinching support and maximum roller deflection, the stop bolts 72 may be adjusted. The magnitude of this adjustment or stop bolt position will depend upon the nature of the workpieces being treated. In order to control or adjust the magnitude of the counter-force desired, the air pressure in bladder 70 may be adjusted.

Referring next to the lower belt driven portion of the infeed 26, which, except for the presence of the endless conveyor belt, is similar to the upper assemblies, it is to be noted that its support wheel assemblies 40, 41 and 42 are supported in a somewhat similar fashion as to the pinch wheel assemblies 30, 31 and 32. That is, each of the pinch wheels 76—76 are supported by side members 78 and mounted for rotation on axles 80 and 82 and are arranged for pivotal movement about axles 82 against the force generated by the compression of an adjustable air bladder 84. The side members 78, now, however, are formed so as to abut the lateral walls of the bladder 84 such that detected irregularities in the lower surface of the rough lumber cause the wheel assemblies 40, 41 and 42 to deflect upwardly or downwardly relative to the air bladder 84, which exerts a controlled resilient counter force, depending upon the position of the stop nut 86 and associated bladder contacting pads 88 and 90. Such members 88 and 90 typically comprise short lengths of flat stock that span the internal width of each wheel assembly and contact the surface of inflated air bladder 84 so as to coact with the side members 78—78 so as to exert the desired counter-force or pressure against pivotal movement of the individual pinch wheels 60—60 in the upper assemblies and 76—76 in the lower assemblies. Pads 88 and 90 are present in each such assembly, and form, in the aggregate, a substantially continuous surface, with individual pads moving in response to the presence of irregularities in the workpieces passing in contact with the individual pinch wheels 60—60 or 76—76.

The driven roller 36 and the adjustable idler roller 38 along with the conveyor belt 34 and the above described support or pinch wheel assemblies 40, 41 and 42 and pinch wheels 30, 31 and 32 essentially comprise the infeed portion of the infeed conveyor. Before continuing though, it is to be noted that the support wheel assemblies 40, 41 and 42 are mounted with their peripheral surfaces extending slightly higher than that of the drive roller 36 and idler roller 38 such that even when the tension is adjusted on the belt 34 via the adjusting mechanism 92, the rough lumber is supported primarily by the wheel assemblies 40, 41 and 42 and not by the drive and idler rollers 36 and 38. Thus, the rough lumber as it passes through the infeed 26 is supported between the upper floating wheel assemblies 30, 31 and 32 and the lower floating wheel assemblies 40, 41 and 42. Depending upon the pneumatic pressure of the individual air bladders (such as air bladder 84) arranged for each of the pinch wheel assemblies, each will deflect upwardly or downwardly as the irregularities in the rough lumber are detected, but the vertical center line of each workpiece of the incoming rough lumber will not vary. In particular, for the present apparatus, it has been found that a tolerance of plus or minus 1/64 of an inch can be maintained for the various thicknesses of rough lumber being treated with the present apparatus. Also, because the grinding drums contain separate suspension systems as disclosed in co-pending U.S. patent application Ser. No. 329,245, filed Dec. 10, 1981, abandoned in favor of continuation application Ser. No. 569,971, filed Jan. 11, 1984 now U.S. Pat. No. 4,512,110, upon adjusting the nominal vertical center line for the stock, the present novel infeed 26 ensures that the stock is finished across its entire width to the earlier referenced 0.005 inch tolerance.

With continuing attention to FIG. 3, the top of the support wheel assemblies 40, 41 and 42 can be seen, it being recalled that this arrangement of support wheels is substantially identical to that of the upper wheel assemblies 30, 31 and 32, with the primary exception being that of the disposition of the air bladders. From this view it is to be apparent that the wheel assemblies 40, 41 and 42 are each comprised of a plurality of wheels 76—76 that are transversely spaced apart from one another and that the wheels 76 of the assemblies 40, 41 and 42 are staggered one to the other such that the full width of the belt 34 may be supported by one or more wheels 76. Thus, irrespective of where surface irregularities are encountered relative to the belt 34, one of the wheels 76 will sense the irregularity and appropriately deflect so as to maintain the desired constant vertical center line across the full width of the incoming workpiece. It should be noted though that some potential insensitivity does occur due to the use of a conveyor belt 34, but it is to be recognized that the pliability of the belt 34 may be adjusted, depending upon desired wearability and the nature of the workpieces normally encountered. In order to maintain axial alignment of the axle shafts 82—82 as well as axle shafts 68—68, axially spaced-apart support bushings are provided on support brackets 94—94.

The present infeed 26 therefore supports the lumber at a relatively constant horizontal position determined by the central plane of each individual workpiece, and the arrangement ensures that only the excess thickness relative to the constant vertical center line is removed or abraded simultaneously from the upper and lower surfaces of the workpiece. Thus, surfacing is performed relative to the horizontal central plane of each individual workpiece and not relative to any high or low thickness irregularities that occur on the rough lumber.

Referring also to FIG. 5, a generalized embodiment of the prior art is shown and wherein the workpiece support is achieved by individual full width notched rollers 102. Such a configuration differs from that of FIG. 3 through use of single rollers 102 rather than individually mounted wheels 76. This configuration, while reducing the sensitivity of the feedworks 26, maintains adequate center line constancy and lateral control only with highly selected workpieces with limited imperfections and warpage.

While the present invention has been described with respect to its preferred embodiment and various alternative embodiments, it is to be recognized that yet still other equivalent structures may suggest themselves to those of skill in the art without departing from the spirit of the present invention. It is therefore contemplated that the present invention should be interpreted to include all such equivalent structures within the spirit and scope of the above description and following claims.

What is claimed is:

1. In a work station having upper and lower rigid frame members spaced apart from one another to define a path for incoming workpieces such that the incoming workpieces may pass along a longitudinal axis extending therebetween, a feedworks assembly comprising:

(a) at least two pairs of opposed pinch wheel assemblies being disposed along the longitudinal path of said incoming workpieces with one member of each pair of pinch wheel assemblies being disposed above said longitudinal path and with the other member of the pair being disposed beneath said path so as to define a workpiece support plane generally midway between the opposed members of each pair, and with each member of each pair comprising a plurality of pivotally mounted floating support wheels, each support wheel adapted for rotation about a wheel rotation axis and being arcuately rockable about a rocking axis to oscillate generally arcuately about said rocking axis and inwardly toward the surface of said incoming workpiece and being coupled to each of said upper and lower frame members in generally opposed relationship;

(b) air bladder means mounted on said frame members for exerting a controlled resilient biasing force upon each floating support wheel while said support wheel is in engagement with said incoming workpieces;

(c) a drive conveyor coupled to said lower frame member and comprising a driven roller, an adjustable idler roller for varying the tension of an endless belt trained thereover, and an endless conveyor belt being trained over said driven roller and idler roller and having an upper flight portion passing over each of the pinch wheel assemblies disposed beneath said longitudinal path; and (d) a transversely extending support shaft disposed coincidentally with and defining each of said rocking axes and spaced laterally from each said wheel rotation axis for accommodating independent rockable arcuate motion of the wheel rotation axis of each of said support wheels, so as to provide resilient opposed upper and lower rotatable supports for workpieces being carried on said conveyor belt while moving therealong with the center planes of said workpieces being movably disposed along a relatively constant horizontal center plane in response to opposed forces being exerted upon said workpieces by said support wheels, and with said support wheels being adapted to be deflected in a direction toward and away from the horizontal plane of said moving workpiece upon encountering and engaging irregularities in the surfaces and thicknesses of said workpieces adjacent to said support wheels without affecting the vertical disposition of said workpieces; the support wheels of two adjacent ones of said pinch wheel assemblies disposed beneath said path being mounted with respect to the same one of said transverse support shafts and spaced apart from said one transverse support shaft in opposite longitudinal directions.

2. Apparatus as set forth in claim 1 wherein each of said opposed pinch wheel assemblies comprises:

(a) first and second side members pivotally coupled to one of said transverse support shafts and having axle shaft means for rotatably supporting said floating support wheel and a backing support interconnecting said first and second side members to form an axle shaft supporting pair;

(b) said air bladder means being an air inflatable resilient air bladder in biasing contact with each of said backing supports for exerting a predetermined force directed against said support wheel so as to move said support wheel toward said longitudinal path and whereby said support wheel is adapted to pivot arcuately toward and away from said horizontal center plane upon encountering irregularities in the surface and thickness of a workpiece passing along said conveyor belt and adjacent to said support wheel.

3. Apparatus as set forth in claim 2 including adjustable bias control means coupled to said air bladder means for varying the biasing force applied to said workpieces thereby.

4. Apparatus as set forth in claim 2 wherein the support wheels of each pinch wheel assembly positioned beneath the upper flight of said conveyor belt are mounted in at least two longitudinally adjacently positioned spaced apart rows and whereby the support wheels of each said longitudinally adjacently positioned and spaced apart rows are transversely staggered relative to the support wheels of the adjacently positioned row, whereby the entire transverse width of the conveyor belt is supported by the surfaces of said support wheels.

5. In combination with an abrasive grinding system having at least one endless abrasive belt, an improved feedworks assembly for conveying workpieces to said abrasive belt and comprising:

(a) at least two pairs of opposed pinch wheel assemblies being disposed along the longitudinal path of said incoming workpieces with one member of each pair of pinch wheel assemblies being disposed above said longitudinal path and with the other member of the pair being disposed beneath said path, and with each member of each pair comprising a plurality of pivotally mounted floating support wheels, each support wheel adapted for rotation about a wheel rotation axis and being arcuately rockable about a rocking axis to oscillate generally arcuately about said rocking axis and inwardly toward the surface of said incoming workpiece and being coupled to each of said upper and lower frame members in generally opposed relationship one to another;

(b) air bladder means mounted on said frame members for exerting a controlled resilient biasing force upon each floating support wheel while said support wheel is in engagement with said incoming workpieces;

(c) a drive conveyor coupled to said lower frame member and comprising a driven roller, an adjustable idler roller for varying the tension of an endless belt trained thereover, and an endless conveyor belt being trained over said driven roller and idler roller and having an upper flight portion passing over each of the pinch wheel assemblies disposed beneath said longitudinal path;

(d) a transversely extending support shaft disposed coincidentally with and defining each of said rocking axes and spaced laterally from each wheel rotation axis for accommodating independent rockable arcuate motion of the wheel rotation axis of each of said support wheels, so as to provide resilient opposed upper and lower rotatable supports for workpieces being carried on said conveyor belt while moving therealong with the center planes of said workpieces being movably disposed along a relatively constant horizontal center plane in response to opposed forces being exerted upon said workpieces by said support wheels, and with said support wheels being adapted to be deflected in a direction toward and away from the horizontal plane of said moving workpieces upon encountering and engaging irregularities in the surfaces and thicknesses of said workpieces adjacent to said support wheels without affecting the vertical disposition of said workpieces; the support wheels of two adjacent ones of said pinch wheel assemblies disposed beneath said path being mounted with respect to the same one of said transverse support shafts and spaced apart from said one transverse support shaft in opposite longitudinal directions; and d (e) an endless abrasive belt trained about at least two axially spaced apart rollers and wherein the axis of rotation of one of said rollers is disposed in predetermined spaced relationship to said horizontal center plane for working contact with the surface of said moving workpiece.

* * * * *